US011399422B2

(12) United States Patent
Deschenes

(10) Patent No.: US 11,399,422 B2
(45) Date of Patent: Jul. 26, 2022

(54) LED FIXTURES FOR CONSTANT CURRENT NETWORK

(71) Applicant: IDEAL Industries Lighting LLC, Durham, NC (US)

(72) Inventor: Pierre Deschenes, Muskego, WI (US)

(73) Assignee: IDEAL INDUSTRIES LIGHTING LLC, Durham, NC (US)

( * ) Notice: Subject to any disclaimer, the term of this patent is extended or adjusted under 35 U.S.C. 154(b) by 153 days.

(21) Appl. No.: 16/694,595

(22) Filed: Nov. 25, 2019

(65) Prior Publication Data

US 2021/0160983 A1 May 27, 2021

(51) Int. Cl.

| | |
|---|---|
| ***H05B 45/345*** | (2020.01) |
| ***F21S 8/08*** | (2006.01) |
| ***F21S 2/00*** | (2016.01) |
| ***F21V 23/06*** | (2006.01) |
| ***H05B 45/38*** | (2020.01) |
| ***H05B 45/40*** | (2020.01) |
| *F21Y 115/10* | (2016.01) |

(52) U.S. Cl.

CPC ..... *H05B 45/345* (2020.01); *F21S 2/005* (2013.01); *F21S 8/085* (2013.01); *F21V 23/06* (2013.01); *H05B 45/38* (2020.01); *H05B 45/40* (2020.01); *F21Y 2115/10* (2016.08)

(58) Field of Classification Search

CPC ..... F21S 2/005; F21S 8/085; F21V 23/06; F21Y 2115/10; H05B 45/382; H05B 45/345

See application file for complete search history.

(56) References Cited

U.S. PATENT DOCUMENTS

| | | | | |
|---|---|---|---|---|
| 2010/0315013 | A1* | 12/2010 | Li | H05B 45/39 315/185 R |
| 2011/0291574 | A1* | 12/2011 | Ji | H05B 45/10 315/187 |
| 2012/0120690 | A1* | 5/2012 | Murai | H05B 45/37 363/55 |
| 2015/0108900 | A1* | 4/2015 | Maa | H05B 45/12 315/149 |
| 2016/0057820 | A1* | 2/2016 | Wang | H05B 47/11 315/158 |
| 2020/0271292 | A1* | 8/2020 | White, III | F21S 8/085 |
| 2020/0292161 | A1* | 9/2020 | Majewski | H05B 45/37 |

* cited by examiner

*Primary Examiner* — Alexander H Taningco
*Assistant Examiner* — Pedro C Fernandez
(74) *Attorney, Agent, or Firm* — Withrow & Terranova, P.L.L.C.

(57) ABSTRACT

A light emitting diode (LED) fixture includes an electrical connector that is configured to receive an input signal from a constant current network that has a voltage in a range from a first voltage value to a second voltage value; an LED load; an LED driver circuit coupled to the LED load, the LED driver circuit configured to operate between a third voltage value and a fourth voltage value, wherein the third voltage value is greater than the first voltage value; and a conversion circuit coupled between the electrical connector and the LED driver circuit, the conversion circuit configured to output an electrical signal in response to the input signal from the constant current network, the electrical signal having a voltage that is between the third voltage value and the fourth voltage value.

16 Claims, 6 Drawing Sheets

LED FIXTURES FOR CONSTANT CURRENT NETWORK

TECHNICAL FIELD

The present invention concerns light emitting devices, and particularly concerns systems and apparatus for providing light emitting devices for constant current networks.

BACKGROUND

Some street lighting systems, particularly early street lighting systems, face challenges with getting the appropriate current to travel long distances without suffering excessive line loss or having to use conductors having impractically large diameters.

One solution for these challenges includes connecting the street lamps in series, effectively daisy-chaining one lamp to another, creating a large loop. Individual lamps may operate on voltages including values as low as 50 volts. A string of 100 lamps could thus utilize 5000 volts on the circuit. Due to the series connection, however, the circuit may operate with low amperage.

Since the lamps are connected in series, the failure of one lamp may affect the entire circuit. One solution for this problem includes the use of an isolation element, such as a transformer. Thus, if a lamp fails, the load on the circuit may change but the remaining lamps will continue to receive power. To reduce the possibility that remaining lamps would receive too much power in the event that other lamps in the circuit fail, a constant current regulator may be included in some circuits.

The constant current regulator may compensate for any reduction in load in the circuit caused by the failure of a lamp. Furthermore the constant current regulator may not need adjustment if additional lamps are added to the circuit as it would similarly compensate for the new load.

SUMMARY

Some embodiments of the invention are directed to LED-based light emitting devices for constant current networks.

According to some embodiments of the present invention, a light emitting diode (LED) fixture includes: an electrical connector that is configured to receive an input signal from a constant current network that has a voltage in a range from a first voltage value to a second voltage value; an LED load; an LED driver circuit coupled to the LED load, the LED driver circuit configured to operate between a third voltage value and a fourth voltage value, wherein the third voltage value is greater than the first voltage value; and a conversion circuit coupled between the electrical connector and the LED driver circuit, the conversion circuit configured to output an electrical signal in response to the input signal from the constant current network, the electrical signal having a voltage that is between the third voltage value and the fourth voltage value.

In some embodiments, the third voltage value is greater than the second voltage value.

In some embodiments, the conversion circuit comprises a transformer coupled to the electrical connector.

In some embodiments, the transformer is an autotransformer.

In some embodiments, the input signal from the constant current network has a voltage that varies between approximately 50V and approximately 110V.

In some embodiments, the electrical connector is configured to receive the input signal from a transformer to which the LED fixture is coupled. In some embodiments, the LED fixture is configured to be coupled to a physical structure of a street lamp.

In some embodiments, a configuration of the conversion circuit is based on the LED load.

In some embodiments, the LED driver circuit is configured to operate on signals having a voltage between 120V and 277V.

In some embodiments, the electrical connector is configured to be releasably coupled to an electrical lighting structure.

According to some embodiments of the present invention, a light emitting diode (LED) fixture includes: an LED load; an LED driver circuit coupled to the LED load; and a step-up circuit configured to receive an input signal from a constant current network and to output an output signal to the LED driver circuit. A minimum voltage of the input signal provided by the constant current network is below a minimum operating voltage of the LED driver circuit.

In some embodiments, the step-up circuit comprises a transformer coupled to the constant current network.

In some embodiments, the transformer is an autotransformer.

In some embodiments, the LED fixture is configured to be coupled to a physical structure of a street lamp.

In some embodiments, the LED driver circuit is configured to operate on signals having a voltage between 120V and 277V.

According to some embodiments of the present invention, a light emitting diode (LED) fixture includes: an electrical connector; an LED load; an LED driver circuit coupled to the LED load; and a step-up circuit comprising an autotransformer between the electrical connector and the LED driver circuit. An input of the autotransformer is configured to be coupled to a constant current network via the electrical connector.

In some embodiments, the LED fixture is configured to be releasably coupled to an electrical lighting structure.

In some embodiments, the LED driver circuit is configured to operate on signals having a voltage between 120V and 277V.

In some embodiments, the electrical connector is configured to receive an input signal from a transformer to which the LED fixture is coupled.

In some embodiments, a configuration of the autotransformer is based on the LED load.

Further aspects of the present invention are explained in greater detail in the drawings herein and the specification below. The disclosures of all United States Patent references cited herein are to be incorporated herein by reference in their entirety.

It should be noted that these figures are intended to illustrate the general characteristics of methods, structure, and/or materials utilized in certain example embodiments and to supplement the written description provided below. These drawings are not, however, to scale and may not precisely reflect the structural or performance characteristics of any given embodiment, and should not be interpreted as defining or limiting the range of values or properties encompassed by example embodiments of the invention. For example, the relative thicknesses and positioning of layers, regions, and/or structural elements may be reduced or exaggerated for clarity. The use of similar or identical reference numbers in the various drawings is intended to indicate the presence of a similar or identical element or feature.

DETAILED DESCRIPTION

The present invention is now described more fully hereinafter with reference to the accompanying drawings, in which embodiments of the invention are shown. This invention may, however, be embodied in many different forms and should not be construed as limited to the embodiments set forth herein; rather these embodiments are provided so that this disclosure will be thorough and complete and will fully convey the scope of the invention to those skilled in the art.

The present invention provides a mechanism by which a light emitting diode (LED) driver that is otherwise configured to operate within a predefined voltage range may be converted for use within a constant current network in which the operating voltages may vary by a much larger range. Such a mechanism allows for LED drivers, and LEDs in general, to be provided as LED fixtures which can be used to retrofit conventional fixtures. The higher efficiency and improved operating characteristics of the LEDs may allow for such LED fixtures to provide technical improvements over the conventional fixtures that would otherwise be used.

Figure 1:
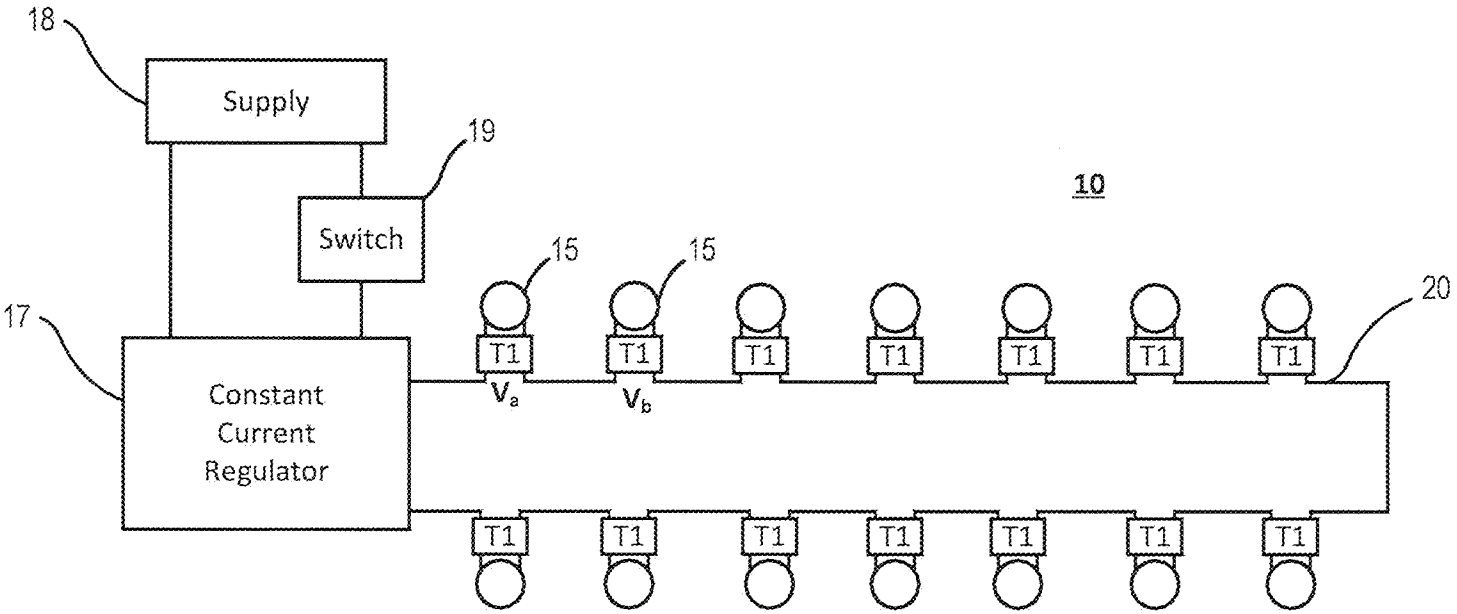
FIG. 1 is a schematic block diagram of a constant current network that may be used with street lamps.

FIG. 1 is a schematic block diagram of a constant current network 10 (or circuit) that may be used with street lamps 15. The LED fixtures according to some embodiments of the present invention may be used in the street lamps 15 shown in FIG. 1. As shown in FIG. 1, the constant current network 10 is configured as an "open loop" series circuit, though the present invention is not limited thereto. A constant current regulator 17 may be coupled to a high-voltage supply 18. The supply 18 of power to the constant current regulator 17 may be controlled by a switch 19. The switch 19 may, for example, be a timer, a relay, or the like.

The power from the supply 18 may be provided to the lamps 15 via conductor 20. As illustrated in FIG. 1 a single conductor 20 may run the entire loop of lamps 15 and return to the constant current regulator 17. The constant current regulator 17 may have a movable secondary winding that automatically changes position to provide constant current for any load within its full-load rating. The balance point between coil weight and magnetic force may be adjusted to provide the desired output current.

The constant current regulator 17 may provide a constant current signal to each lamp 15 having a current value that is substantially constant. As used herein, a "constant current signal" refers to an electrical signal in which the current value (such as DC value or an RMS value in the case of an alternating current) does not vary appreciably regardless of a variation in the load of the circuit. In some embodiments, the constant current regulator 17 may provide a current signal with a current of 6.6 A. In some embodiments, the voltage supplied to the constant current network 10 may be in the kilovolt range, but the voltage may vary according to the number of operating lamps 15 in the constant current network 10 at any given time.

For example, FIG. 1 illustrates a first lamp 15 having an operating voltage of $V_a$ and a second lamp having an operating voltage of $V_b$. $V_a$ and $V_b$ may be different from one another (e.g., due to the voltage drop that occurs due to the resistance of the conductor 20 as the electrical signal travels along the conductor 20). Moreover, $V_a$ and/or $V_b$ may vary during operation of the constant current network 10 due to variations in the load that may result from failure of one or more lamps, addition of lamps, aging of the equipment (e.g., the LEDs), temperature variations, etc. For example, $V_a$ and/or $V_b$ may vary from between approximately 50V and approximately 110V.

Each lamp 15 may be coupled to a respective isolation element, such as a transformer T1, which may keep a failure of the lamp 15 from affecting (e.g., interrupting power flow to) other parts of the constant current network 10.

Each of the lamps 15 may include a lighting fixture. The lighting fixture may include, for example, a gas discharge lamp. Examples of gas discharge lamps utilized in conventional lamps 15 include high pressure sodium (HPS) and low pressure sodium (LPS) lamps. In some embodiments, the lighting fixture may be a luminaire coupled to a structure, such as a lighting pole. Embodiments of the present invention may allow for a conventional lighting fixture (e.g., a gas discharge-based luminaire) to be replaced with an LED fixture (e.g., an LED-based luminaire).

There is increasing interest in replacing the lighting fixtures in conventional lamps 15 with LED lighting fixtures due to the improved operational efficiency and extended life of LEDs as compared to conventional lighting devices. However, as discussed above, conventional lamps 15 may be configured to operate within a constant current network 10. LED drivers that may be utilized within retrofit LED lighting fixtures may be typically configured to operate within a 120V to 277V range. Such LED drivers may have difficulty operating in a constant current network 10 due to the wide variance in the operating voltage provided by the constant current network 10. For example, while the upper ranges of the constant current network 10 may be within the operating range of a conventional LED driver, lower limits of the operating voltage provided by the constant current network 10 through the transformer T1 (e.g., approximately 50V may be output from the transformer T1 to the lamp 15) may be below the operating range of the conventional LED drivers. As such, retrofitting a lamp 15 with an LED lighting fixture poses additional challenges.

Figure 2A:
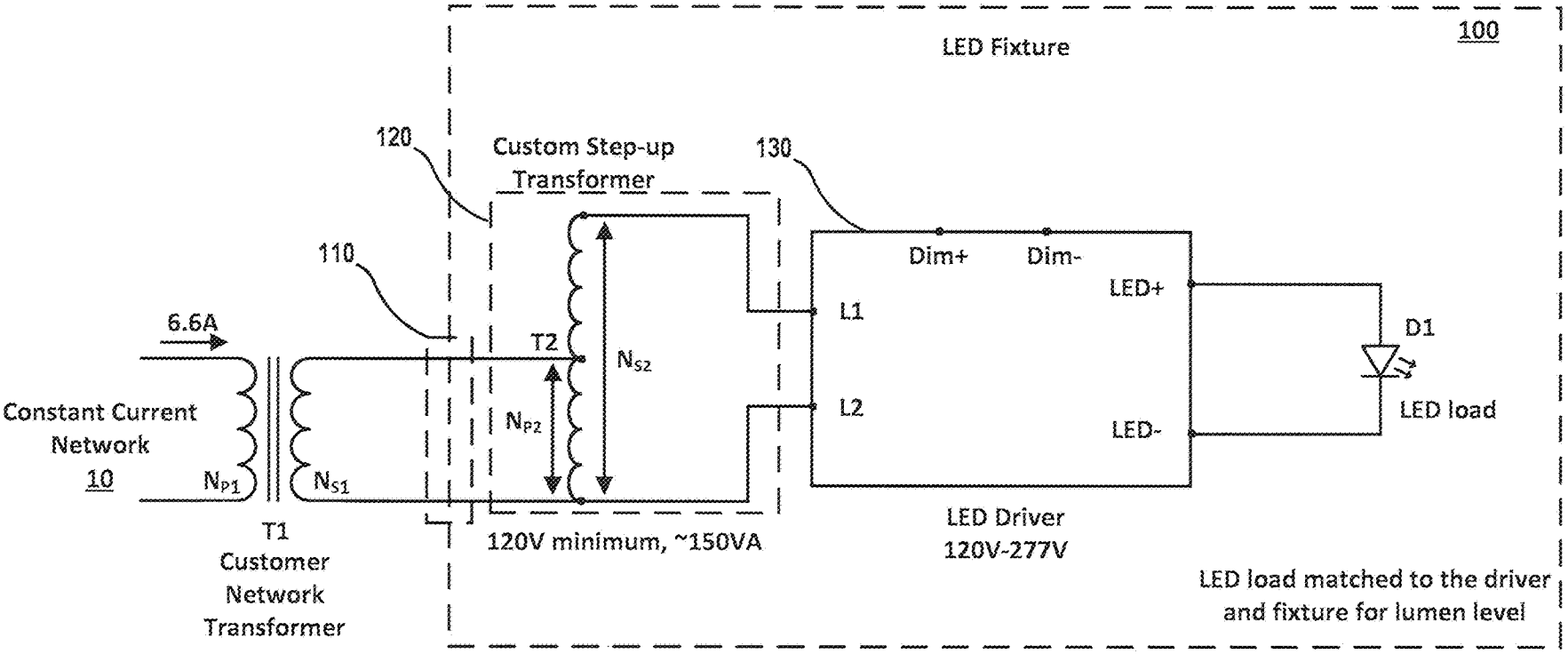
FIG. 2A is a schematic diagram of a circuit for an LED lighting fixture that may be used in the constant current network of FIG. 1, according to some embodiments of the present invention.

FIG. 2A is a schematic diagram of a circuit for an LED fixture 100 that may be used in the constant current network 10 of FIG. 1, according to some embodiments of the present invention. As illustrated in FIG. 2A, the LED fixture 100 may be configured to connect to a constant current network 10, such as that illustrated in FIG. 1.

The constant current network 10 may be isolated from the LED fixture 100 by an isolation element. For example, a transformer T1 may be provided between the constant current network 10 and the LED fixture 100. The transformer T1 may include, for example, an inductive transformer including primary and secondary coils that are inductively coupled to one another. For example, the transformer T1 may include a primary coil having $N_{P1}$ turns and a secondary coil having $N_{S1}$ turns. The transformer T1 may provide, for example, galvanic isolation between the LED fixture 100 and the constant current network 10. Though a transformer T1 is illustrated as the isolation element in FIG. 2A, it will be understood that other isolation elements, such as a cutout, may be utilized without deviating from the present invention.

In some embodiments, the transformer T1 may receive, as input from the constant current network 10, an electrical signal having a current that is 6.6 A and a voltage that varies depending on the load on the constant current network 10. The transformer T1 may output a voltage that varies between approximately 50V and approximately 110V and a current signal that similarly varies depending on the load.

Figure 2B:
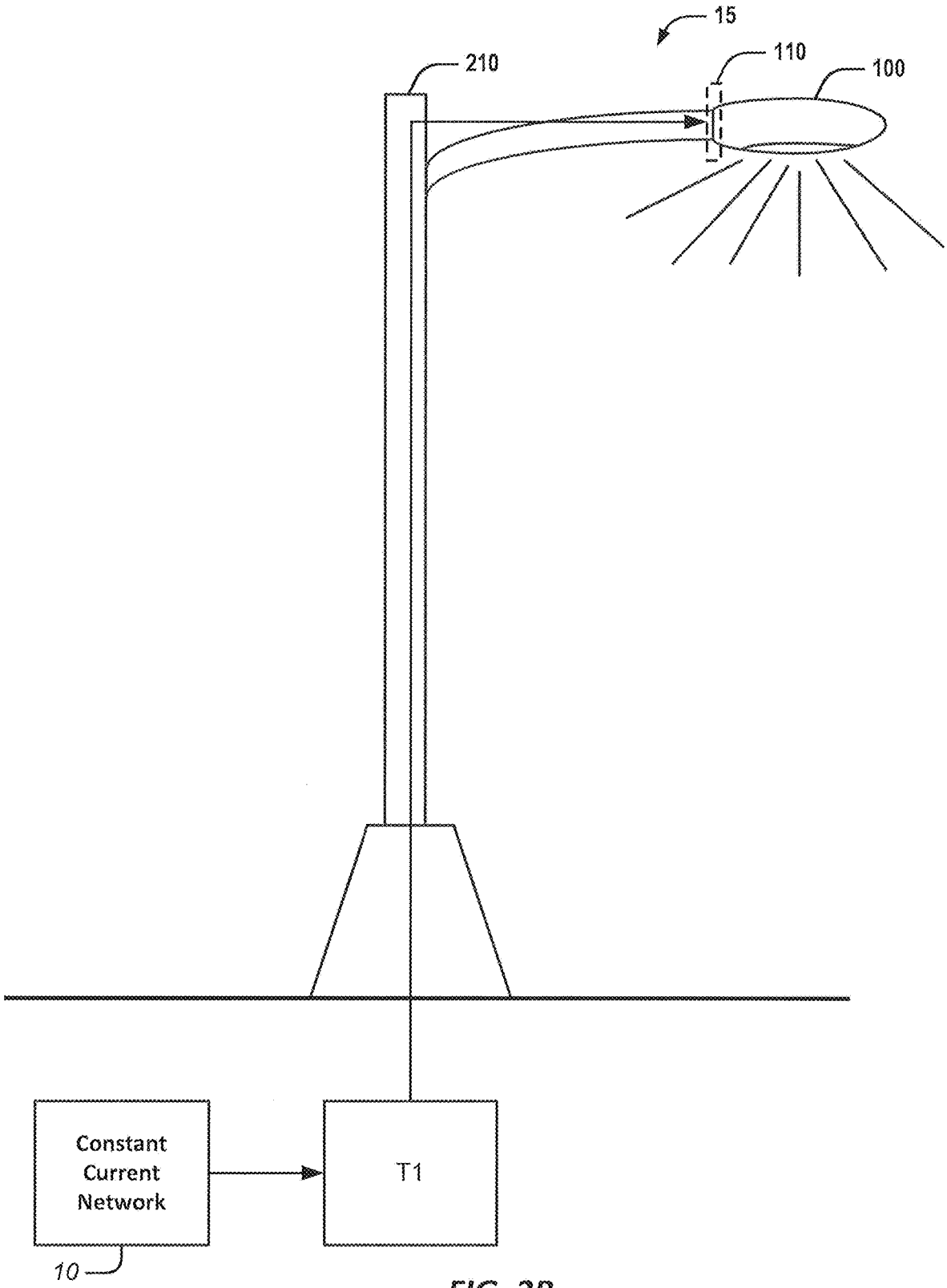
FIG. 2B is a schematic diagram of the LED lighting fixture of FIG. 2A coupled to a pole of a lamp, according to some embodiments of the present invention.

In some embodiments, the LED fixture 100 may be configured to be releasably coupled to a structure, such as a pole of a street lamp (e.g., lamp 15 of FIG. 1), via an electrical connector 110. FIG. 2B is a schematic diagram of the LED lighting fixture of FIG. 2A coupled to a pole of a lamp 15, according to some embodiments of the present invention. As illustrated in FIG. 2B, a lamp 15 may include a physical structure 210 anchored and/or secured to the ground and the LED fixture 100 may be provided as a fixture that screws or is otherwise attached to the structure 210 through electrical connector 110. In some embodiments, the transformer T1 may be coupled to the LED fixture 100 through the structure 210. For example, the structure 210 may be a light pole and the transformer T1 may be placed in the ground beneath the light pole. In some embodiments, the electrical connector 110 may be a wire or other interface that couples to a wire or other interface in the structure 210 that is further coupled to the transformer T1. In some embodiments, the electrical connector 110 may be a connector (e.g., a standardized connector) that is configured to be releasably coupled to an existing lighting device. In some embodiments, the LED lighting fixture 100 may be provided as a luminaire that is configured to be attached to an existing lighting pole of a street lamp.

Referring back to FIG. 2A, a conversion circuit 120 may be coupled to the electrical connector 110 and an LED driver 130 may be coupled to the conversion circuit 120. The LED driver 130 may be configured to convert an input electrical signal provided to the LED fixture 100 for use in driving an LED load (e.g., to provide illumination). The LED load is represented as D1 in FIG. 2A. Though only a single LED is illustrated as part of the LED load, it will be understood that this is merely an example, and that other configurations of LED load may be provided without deviating from the invention. Typically, a large number of LEDs may be included in LED load D1.

The LED driver 130 may be configured to operate with a typical input voltage between 120V and 277V, with a variation of plus or minus 10%. For example, the LED driver 130 may be configured to process and/or otherwise manipulate the input electrical signal (shown as being provided on input ports L1 and L2) to operate the LED load D1. In some embodiments, the LED driver 130 may provide a power signal selectively to LEDs of the LED load D1 to control a color and/or intensity of light emitted by the LED load D1. In some embodiments, the operation of the LED driver 130 may be controlled by other inputs, such as dimming inputs Dim+ and Dim−, thought the present invention is not limited thereto.

The conversion circuit 120 may be configured to convert an electrical signal from the electrical connector 110 (e.g., the output of transformer T1) into a power signal having a voltage within a voltage range sufficient to be used for an LED driver 130. For example, the voltage range of the electrical signal received via the electrical connector 110 (e.g., between 50V and approximately 110V) may be insufficient to operate the LED driver 130. The conversion circuit 120 may alter or otherwise manipulate the electrical signal received via the electrical connector 110 so as to be compatible with the LED driver 130. In some embodiments, the conversion circuit 120 may be configured to provide a power signal having a minimum voltage of 120V as output to the LED driver 130 with the capability of providing approximately 150VA of apparent power, though the present invention is not limited thereto. In some embodiments, the power signal from the conversion circuit may be tailored to match the load (e.g., the wattage of the street lamp) for the application.

In some embodiments, the conversion circuit 120 may be configured as a step-up autotransformer T2. For example, an autotransformer T2 may be connected so as to have a primary side with a first number of primary windings $N_{P2}$ and a secondary side with a second number of secondary windings $N_{S2}$. The second number of secondary windings $N_{S2}$ may be greater than the first number of primary windings $N_{P2}$.

The autotransformer T2 may be configured to increase (e.g., "step-up") a voltage of a power signal provided at its input as output of the autotransformer T2. The output of the autotransformer T2 may be provided as the input to the LED driver 130. In some embodiments, the autotransformer T2 may be configured to double the voltage of the input power signal provided from the transformer T1, though the present invention is not limited thereto.

The configuration of the autotransformer T2 (e.g., the number of turns, wire gauge, etc.) may be dependent on the LED load D1. For example, in an LED fixture 100 that is configured to provide a first wattage output to its LED load D1, the configuration of the autotransformer T1 may differ from that of an LED fixture 100 that is configured to provide a second, different, wattage output to its LED load D1.

Though conversion circuit 120 is illustrated as an autotransformer T2, other types of step-up circuits may be provided as the conversion circuit 120 without deviating from the present invention. For example, the conversion circuit 120 may utilize a galvanically isolated transformer, similar to the transformer T1, instead of, or in addition to, the autotransformer T2, with the transformer configured (e.g., in terms of primary and secondary coils) to step up the input voltage to a level sufficient for the LED driver 130.

Other, non-transformer conversion circuits 120 may be utilized as well. For example, the conversion circuit 120 may be implemented as a step-up circuit using semiconductor switches, such as power MOSFETs. Other embodiments of conversion circuits 120 consistent with the present invention may be possible without deviating from the present invention.

The LED fixture 100 may be provided in a form factor that is configured to replace existing lighting fixtures in conventional devices. Thus, the LED driver 130, the LED load D1, and the conversion circuit 120 may be combined within a housing that is capable of being releasably coupled to a conventional lighting structure. In this way, the present invention provides a mechanism to retrofit conventional lighting devices with more efficient LED devices while still operating within the constant current network of the conventional lighting system.

Figure 3:
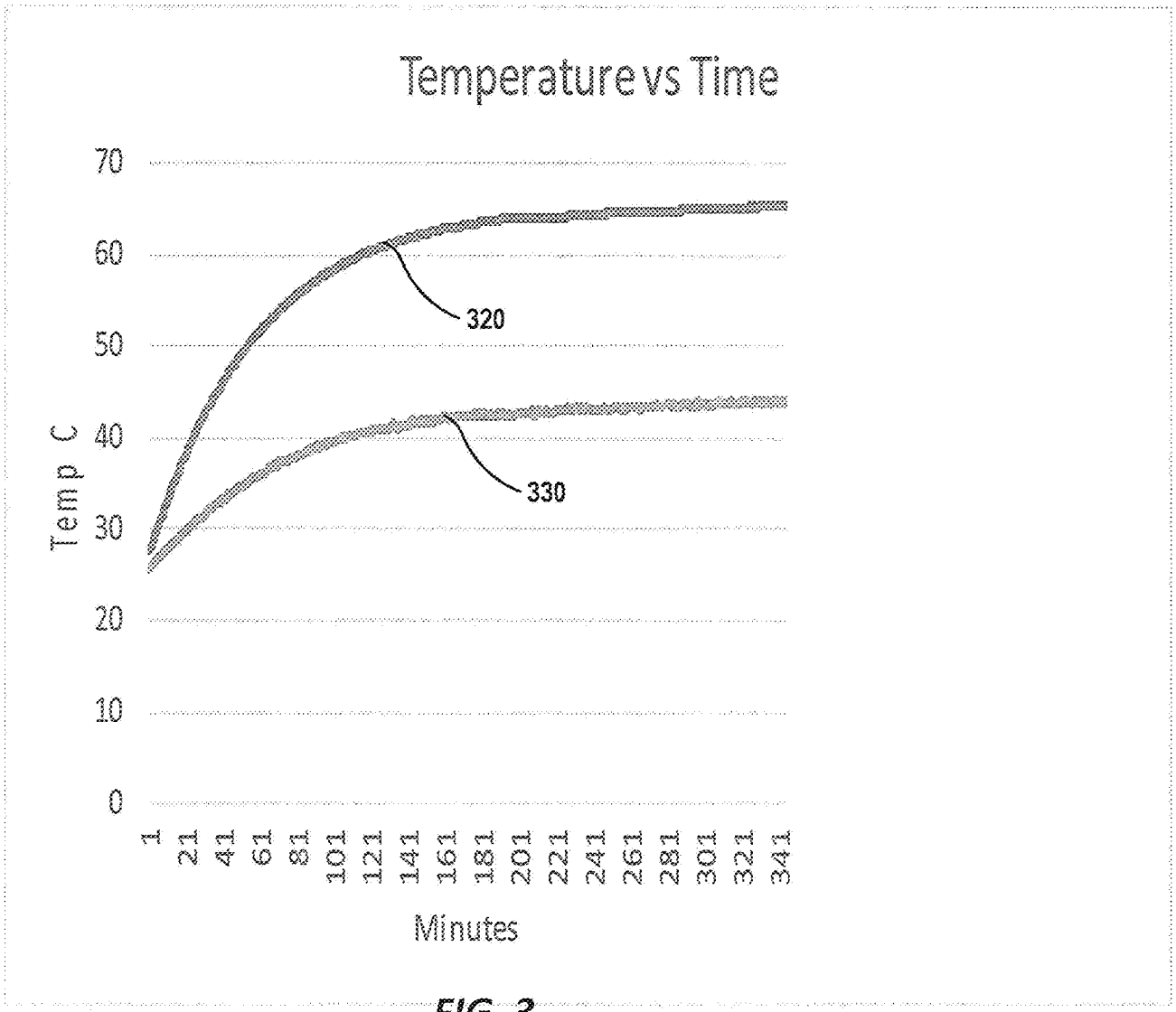
FIGS. 3 and 4 illustrate example operating characteristics of some embodiments of the present invention.
Figure 4:
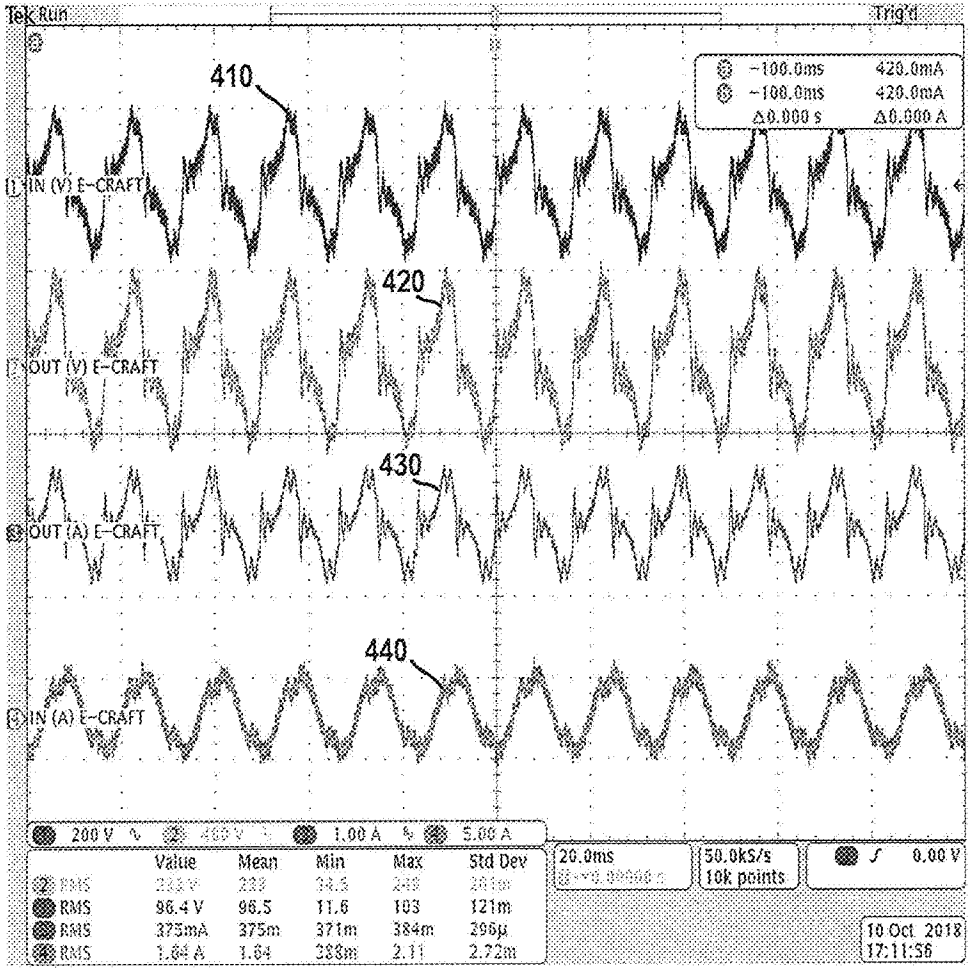

FIGS. 3 and 4 illustrate example operating characteristics of some embodiments of the present invention. FIG. 3 is a graph comparing the measured temperature 320 of a transformer (e.g., an autotransformer T2 of FIG. 2) of an LED lighting fixture according to an embodiment of the present invention as compared to the measured ambient temperature 330 within the lighting fixture. As illustrated in FIG. 3 embodiments of the present invention are capable of staying below 70 degrees C. during operation, with the increase in temperature of the autotransformer rising similarly to the ambient temperature within the LED lighting fixture.

FIG. 4 illustrates a measured trace of the input voltage 410 and input current 440 of the autotransformer T2 of an LED lighting fixture according to an embodiment of the present invention as compared to the output voltage 420 and output current 430 of the autotransformer T2. As illustrated in FIG. 4, the autotransformer T2 may be capable of converting an input electrical signal having an input current 440 of 1.64 A (RMS) and an input voltage 410 of 96.4 V (RMS) received from the constant current network 10 to a power signal having an output current 430 of 375 mA (RMS) and an output voltage 420 of 233V (RMS). As illustrated in the configuration of FIG. 2A, the output current 430 and the output voltage 420 of the autotransformer T2 may be provided to the LED driver 130. In the embodiment illustrated by the measurements of FIG. 4, absent the conversion circuit 120 and the autotransformer T2, the input voltage of 96.4V would not be sufficient to operate the LED driver 130. Thus, the conversion circuit 120 and the autotransformer T2 provide a mechanism by which the LED driver 130 can operate with the constant current network 10.

Figure 5:
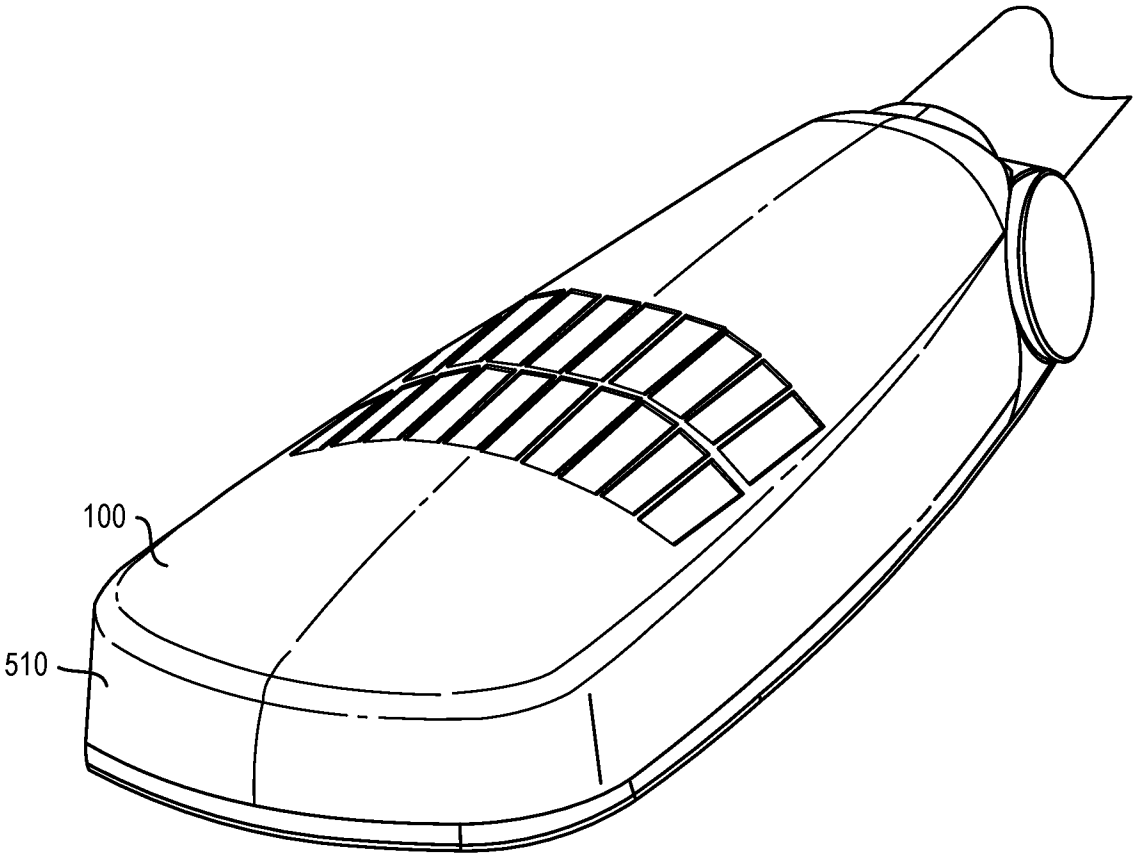
FIG. 5 illustrates an example embodiment of an LED lighting fixture according to some embodiments of the present invention.

FIG. 5 illustrates an example embodiment of an LED lighting fixture 100 according to some embodiments of the present invention. As illustrated in FIG. 5, the LED fixture 100 may be embodied as a luminaire that may be configured to be releasably coupled to a lighting structure, such as a lighting pole of a street lamp. In some embodiments, the LED driver, LED load, and conversion circuit (see FIG. 2A) may be provided within a housing 510 of the LED fixture 100. The LED fixture 100 may be utilized as a replacement lighting fixture in a conventional lighting infrastructure utilizing a constant current network, such as the constant current network 10 of FIGS. 1 and 2.

The terminology used herein is for the purpose of describing particular embodiments only and is not intended to be limiting of the invention. As used herein, the singular forms "a," "an," and "the" are intended to include plural forms as well, unless the context clearly indicates otherwise. It will be further understood that the terms "comprises" or "comprising," when used in this specification, specify the presence of stated features, integers, steps, operations, elements, components, and/or groups or combinations thereof, but do not preclude the presence or addition of one or more other features, integers, steps, operations, elements, components, and/or groups or combinations thereof.

As used herein, the term "and/or" includes any and all possible combinations or one or more of the associated listed items, as well as the lack of combinations when interpreted in the alternative ("or").

The term "about" or "approximately," as used herein with respect to a value or number, means that the value or number can vary by +/−fifteen percent (15%).

Unless otherwise defined, all terms (including technical and scientific terms) used herein have the same meaning as commonly understood by one of ordinary skill in the art to which this invention belongs. It will be further understood that terms, such as those defined in commonly-used dictionaries, should be interpreted as having a meaning that is consistent with their meaning in the context of the specification and claims and should not be interpreted in an idealized or overly formal sense unless expressly so defined herein. Well-known functions or constructions may not be described in detail for brevity and/or clarity.

It will be understood that when an element is referred to as being "on," "attached" to, "connected" to, "coupled" with, "contacting," etc., another element, it can be directly on, attached to, connected to, coupled with, and/or contacting the other element or intervening elements can also be present. In contrast, when an element is referred to as being, for example, "directly on," "directly attached" to, "directly connected" to, "directly coupled" with, or "directly contacting" another element, there are no intervening elements present. It will also be appreciated by those of skill in the art that references to a structure or feature that is disposed "adjacent" another feature can have portions that overlap or underlie the adjacent feature.

Spatially relative terms, such as "under," "below," "lower," "over," "upper," and the like, may be used herein for ease of description to describe an element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus the exemplary term "under" can encompass both an orientation of over and under. The device may otherwise be oriented (rotated 90 degrees or at other orientations) and the spatially relative descriptors used herein interpreted accordingly. Similarly, the terms "upwardly," "downwardly," "vertical," "horizontal," and the like are used herein for the purpose of explanation only, unless specifically indicated otherwise.

It will be understood that, although the terms first, second, etc., may be used herein to describe various elements, components, regions, layers, and/or sections, these elements, components, regions, layers, and/or sections should not be limited by these terms. Rather, these terms are only used to distinguish one element, component, region, layer, and/or section, from another element, component, region, layer, and/or section. Thus, a first element, component, region, layer, or section discussed herein could be termed a second element, component, region, layer, or section without departing from the teachings of the present invention. The sequence of operations (or steps) is not limited to the order presented in the claims or figures unless specifically indicated otherwise.

The foregoing is illustrative of the present invention, and is not to be construed as limiting thereof. The invention is defined by the following claims, with equivalents of the claims to be included therein.

I claim:

1. A light emitting diode (LED) fixture comprising:

an electrical connector that is configured to receive an input signal from a constant current network that has a voltage which varies as a function of a load of the constant current network in a range from a first voltage value to a second voltage value;

an LED load;

an LED driver circuit coupled to the LED load, the LED driver circuit configured to operate between a third voltage value and a fourth voltage value, wherein the third voltage value is greater than the first voltage value; and a conversion circuit coupled between the electrical connector and the LED driver circuit, the conversion circuit comprising an autotransformer coupled to the electrical connector, wherein the conversion circuit is configured to output an electrical signal in response to the input signal from the constant current network, the electrical signal having a voltage that is between the third voltage value and the fourth voltage value.

2. The LED fixture of claim 1, wherein the third voltage value is greater than the second voltage value.

3. The LED fixture of claim 1, wherein the input signal from the constant current network has a voltage that varies between approximately 50V and approximately 110V.

4. The LED fixture of claim 1, wherein the electrical connector is configured to receive the input signal from the autotransformer to which the LED fixture is coupled.

5. The LED fixture of claim 1, wherein the LED fixture is configured to be coupled to a physical structure of a street lamp.

6. The LED fixture of claim 1, wherein a configuration of the conversion circuit is based on the LED load.

7. The LED fixture of claim 1, wherein the LED driver circuit is configured to operate on signals having a voltage between 120V and 277V.

8. The LED fixture of claim 1, wherein the electrical connector is configured to be releasably coupled to an electrical lighting structure.

9. A light emitting diode (LED) fixture comprising:

an LED load;

an LED driver circuit coupled to the LED load; and a step-up circuit configured to receive an input signal from a constant current network and to output an output signal to the LED driver circuit, the step-up circuit comprising an autotransformer coupled to the constant current network;

wherein the input signal provided by the constant current network has a voltage which varies as a function of a load and a minimum voltage of the input signal is below a minimum operating voltage of the LED driver circuit.

10. The LED fixture of claim 9, wherein the LED fixture is configured to be coupled to a physical structure of a street lamp.

11. The LED fixture of claim 9, wherein the LED driver circuit is configured to operate on signals having a voltage between 120V and 277V.

12. A light emitting diode (LED) fixture comprising:

an electrical connector;

an LED load;

an LED driver circuit coupled to the LED load; and a step-up circuit comprising an autotransformer between the electrical connector and the LED driver circuit, wherein an input of the autotransformer is configured to be coupled to a constant current network via the electrical connector, the constant current network having a voltage which varies as a function of a load.

13. The LED fixture of claim 12, wherein the LED fixture is configured to be releasably coupled to an electrical lighting structure.

14. The LED fixture of claim 12, wherein the LED driver circuit is configured to operate on signals having a voltage between 120V and 277V.

15. The LED fixture of claim 12, wherein the electrical connector is configured to receive an input signal from the autotransformer to which the LED fixture is coupled.

16. The LED fixture of claim 12, wherein a configuration of the autotransformer is based on the LED load.

* * * * *